United States Patent [19]

Williams

[11] 4,242,881

[45] Jan. 6, 1981

[54] REFRIGERATION SYSTEM AND THERMAL EXCHANGER THEREFOR

[76] Inventor: Alea Williams, 1930 Asbury, Evanston, Ill. 60201

[21] Appl. No.: 2,619

[22] Filed: Jan. 11, 1979

Related U.S. Application Data

[63] Continuation-in-part of Ser. No. 780,777, Mar. 24, 1977, Pat. No. 4,144,718.

[51] Int. Cl.[3] ..... B67D 5/62; F25B 41/04

[52] U.S. Cl. ..... 62/225; 62/399; 165/156

[58] Field of Search ..... 165/156; 62/394, 399, 62/225

[56] References Cited

U.S. PATENT DOCUMENTS

| | | | |
|---|---|---|---|
| 2,324,257 | 7/1943 | Ekert | 165/156 X |
| 2,762,209 | 9/1956 | Bennett | 62/394 X |
| 3,280,592 | 10/1966 | Barday | 62/457 |
| 4,090,558 | 5/1978 | Akama | 165/156 X |

*Primary Examiner*—William E. Wayner

*Attorney, Agent, or Firm*—Tilton, Fallon, Lungmus & Chestnut

[57] ABSTRACT

An improved refrigeration system, and particularly the thermal exchanger therefor, for use in chilling a circulating water supply for industrial equipment. The system includes a water container having a plurality of thermal exchangers therein, each exchanger including a coiled refrigerant tube, a first water tube extending coaxially through the refrigerant tube, and a second water tube helically wound about the refrigerant tube. The inlet of the helical water tube communicates with the outlet of the coaxial water tube, and the flow of refrigerant in the coaxial refrigerant and water tubes is in opposite directions. The helical water tube has an outlet which discharges cool water into the container near the inlet end of the refrigerant tube.

12 Claims, 2 Drawing Figures

REFRIGERATION SYSTEM AND THERMAL EXCHANGER THEREFOR

RELATED APPLICATION

This application is a continuation-in-part of my co-pending application Ser. No. 780,777, filed Mar. 24, 1977, now U.S. Pat. No. 4,144,718.

BACKGROUND AND SUMMARY

This invention relates to an improved refrigeration system for chilling a circulating water supply for reuse in cooling industrial equipment, and particularly to the thermal exchanger of such a system.

Water chillers are useful for chilling a circulating water supply for reuse in the cooling of industrial equipment. The uses for such equipment are many including typical applications such as injection blow molding, extruding, printing and etching, controlled chemical processing, controlled food processing, and industrial machine cooling. It has been found, for instance, that use of a water chiller with many industrial machines, such as hydraulic presses, compressors, metal treating ovens, and special metal fabrication processes results in definite improvements in operating efficiency. The advantages of using such equipment have been readily apparent to those skilled in the art even though such equipment has previously not been fully developed to the desired extent. With the water chillers heretofore available, it has been necessary to utilize complex refrigeration equipment of large capacity using significant amounts of energy even then oftentimes failing to achieve a fully satisfactory temperature drop in the circulating water supply.

With respect to most prior water chillers, the refrigeration systems have usually been conventional designs of types commonly available for many years. The coiled refrigerant tubes or evaporators are simply emersed in a container of water to chill the water used to cool the equipment. It is significant to note that such systems continuously introduce or mix hot water coming from the equipment to be chilled with partially chilled water being withdrawn for recirculation to the equipment. The coiled refrigerant tubes or evaporators are therefore impeded in achieving the desired temperature drop in the water by reason of the constant intermixing of hot water with the partially chilled water.

U.S. Pat. Nos. 3,435,627, 3,310,103, and 3,180,108 disclose systems representing prior attempts to overcome some of such problems. Other patents reflecting the state of the art are U.S. Pat. Nos. 2,762,209, 2,511,582, 2,471,137, and 3,280,592.

In the aforementioned co-pending application, a system is disclosed wherein two or more thermal exhange assemblies are disposed within a container below the normal water level thereof, each assembly including a coiled refrigerant tube and a coiled water tube coaxially disposed therein, the flow through the water tube being in a direction opposite to the flow of refrigerant, and the water outlet of one assembly being connected to the water inlet of the next assembly to dispose the water circuits of the two assemblies in series relation. Water cooled by the assembly of the final stage is discharged directly into the container. Such application also discloses other features, including the provision of separate expansion valves for each of the thermal exchange assemblies.

In the system of the present invention, the thermal exchanges each comprise three tubes. A coiled refrigerant tube has a coaxial water tube of substantially smaller diameter extending therethrough, the two tubes being arranged so that refrigerant and water flow in opposite directions. The outlet for the coaxial water tube is connected to the inlet of a helical second water tube which is wound about the outside of the refrigerant tube, thus carrying chilled water in a helical passage and in a reverse direction along the outside of the refrigerant tube. It has been found that such a relationship promotes greater cooling efficiency and results in a highly effective water cooling system.

In the embodiment disclosed, each thermal exchange assembly discharges cold water from its helical water tube directly into the enclosure which forms the water container; hence, such assemblies operate in parallel rather than in series. It has been found that the high cooling efficiency of such thermal exchange assemblies makes parallel operation particularly suitable; however, a series arrangement might be utilized, with the outlet of a helical water tube of one assembly discharging into the inlet of the coaxial water tube of the next assembly, if cooling to extremely low temperatures is required.

Other objects, features, and advantages of the invention will appear from the specification and drawings.

DRAWINGS

DESCRIPTION OF PREFERRED EMBODIMENT

Figures 1, 2:
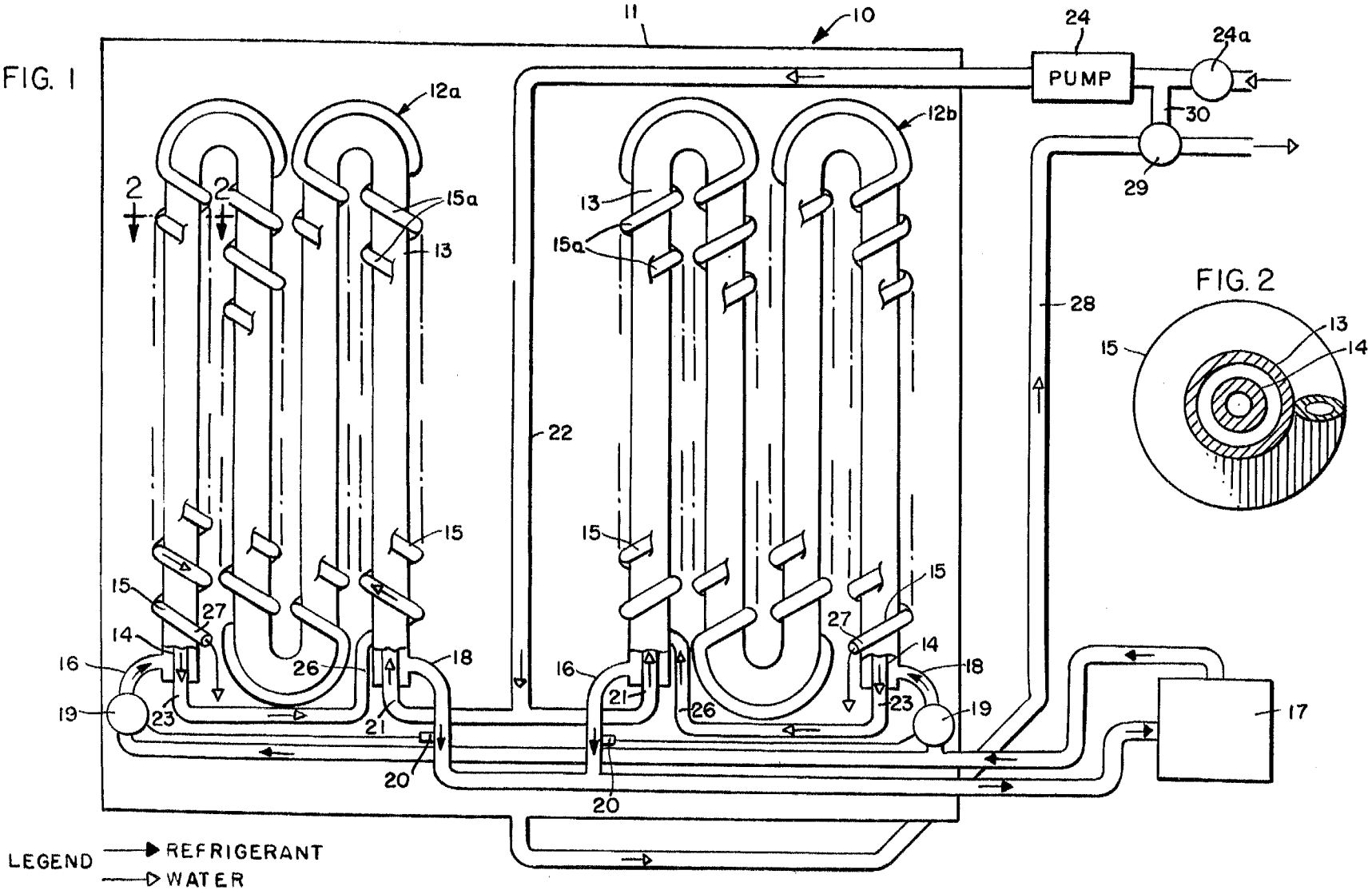
FIG. 1 is a schematic view of an improved refrigeration system embodying this invention.
FIG. 2 is an enlarged cross sectional view taken along line 2—2 of FIG. 1.

Referring to the drawings, the numeral 10 generally designates an improved refrigeration system for chilling a circulating water supply for reuse in cooling industrial equipment (not shown). The refrigeration system includes a water container 11 having therein a plurality of thermal exchange assemblies **12*a* and 12*b*. Each assembly includes a coiled refrigerant tube 13, an internal coaxial water tube 14, and a helical external water tube 15**. Since the two assemblies as shown are substantially the same in form and function, it will be understood that the description of one is applicable to the other.

Refrigerant tube 13 may be coiled in any conventional configuration. The coil may, for example, assume the serpentine configuration shown (although such configuration is presented in FIG. 1 as a schematic representation of any type of coil), or it may assume the shape of a spiral of generally cylindrical or other conventional configuration. Refrigerant inlet means 16 is provided at one end of the coiled refrigerant tube through which refrigerant from a condenser within housing 17 may flow into the refrigerant tube. Refrigerant outlet means 18 is provided at the other end of the refrigerant tube from which refrigerant may flow to a compressor also disposed within housing 17. The inlet and outlet means take the form of tubes disposed at opposite ends of the refrigerant tube and communicating directly therewith. A thermostatically responsive expansion valve 19 is provided in the refrigerant inlet means or tube 16 and is associated with sensing means 20 for sensing the temperature of the refrigerant as it flows through outlet means or tube 18. The expansion valve opens at a first preselected temperature and closes at a second preselected temperature lower than the first temperature, the sensing means being a thermocouple controlling the opening and closing of the expansion valve in response to temperature changes in the refrigerant flowing through outlet tube 18. It is to be observed that separate expansion valves 19 and sensors 20 are provided for each of the thermal exchange assemblies 12*a* and 12*b*.

The water tube 14 coaxially disposed within refrigerant tube 13 is of substantially smaller cross sectional dimensions than the refrigerant tube, as shown most clearly in FIG. 2. An annular space is therefore provided between the outer surface of the water recirculation tube 14 and the inner surface of the refrigerant tube, such annular space constituting the passageway for the flow of refrigerant. While it is believed that the relative sizes of the tubes may vary considerably, a preferred ratio between the inner diameter of the refrigerant tube and the outer diameter of the water tube is believed to be on the order of 2:1.

The inlet means 21 of water tube 14 communicates with a supply tube 22 which returns warm water from whatever industrial equipment (not shown) the system is designed to be used with. A suitable pump 24 and valve 24*a* are provided in line 22 to control the flow of heated water into the refrigeration system. It is to be noted that the inlet 21 of the coaxial water tube 14 is disposed adjacent the outlet means 18 of the refrigeration tube 13. Similarly, the outlet 23 of the coaxial water tube 14 is disposed at the other end of the refrigeration tube adjacent outlet means 16. Flow is countercurrent, thereby achieving a more uniform temperature differential for maximum cooling efficiency throughout the full length of the refrigeration tube 13.

The tubular outlet end 23 of the coaxial water tube 14 communicates with the inlet end 26 of helical outer water tube 15, the inlet 26 being disposed in close proximity to the outlet means 16 of the refrigeration tube. As shown, the outer water tube 15 is wound about the refrigeration tube 13 along substantially the full length thereof, with the outer surfaces of the two tubes in direct contact with each other and with the general direction of flow through the helical water tube being opposite to the direction of flow of refrigerant. Ideally, the helical outer water tube 15 is secured by welding or other suitable means directly to the refrigeration tube. The outlet 27 of the spiral water tube 15 is disposed adjacent the opposite (inlet) end of refrigeration tube and, in the illustration given, discharges cold water directly into the interior of container or housing 11.

In normal operation of the system, the water level 28 within container 11 is above the thermal exchange assemblies 12*a* and 12*b*. Water within the container is maintained in cold condition because of direct contact between such water and the outer surface of helical tube 15 and, in those cases where the coils or convolutions 15*a* are spaced apart, the water in the container is also maintained in cold condition by direct contact with the refrigeration tube 13. The spacing between successive convolutions 15*a* may vary considerably, depending at least in part on the relative cross sectional dimensions of the respective tubes. Preferably, the outer helical water tube 15 has the same cross sectional dimensions as those of inner water tube 14 and, in that event, it is believed that the spacing between successive convolutions should be no greater than five times the outside diameter of tube 15.

Cold water from container 11 is carried back to the industrial equipment for the purpose of cooling such equipment by means of a return line or conduit 28, valve 29, and pump 23. As shown in FIG. 1, a bypass passage 30 may be provided for recirculating coolant where such recirculation would assist in maintaining proper coolant temperatures, avoiding overcooling of the equipment, etc.

In the embodiment shown, water supply line 22 directs warm water to both thermal exchange assemblies 12*a* and 12*b* and, similarly, the outlets 27 of the outer helical tubes 15 both discharge cold water directly into container 11. The assemblies therefor operate in parallel. It is to be understood, however, that if desired such assemblies may operate in series with supply line 22 communicating with the inlet 21 of only one of the assemblies, the outlet 27 of that same assembly communicating directly with the inlet 21 of the adjacent assembly.

All of the tubes 13–15 are formed of a material having high thermal conductivity and high corrosion resistance. Copper has been found particularly effective but other metals or other suitable materials might be used.

While in the foregoing I have disclosed an embodiment of this invention in considerable detail for purposes of illustration, it will be understood by those skilled in the art that many of these details may be varied without departing from the spirit and scope of the invention.

I claim:

1. A refrigerant-water thermal exchange assembly for cooling water for industrial use, said assembly comprising a coiled refrigerant tube having refrigerant inlet means at one end thereof for receiving refrigerant from a condenser and having refrigerant outlet means at the opposite end thereof for discharging the refrigerant to a compressor, a coaxial water tube disposed within said refrigerant tube, said coaxial water tube having an outside diameter substantially smaller than the inside diameter of said refrigerant tube and having water inlet means adjacent said refrigerant outlet means for receiving water to be cooled, said coaxial water tube also having water outlet means adjacent said refrigerant inlet means, and a helical water tube coiled about said refrigerant tube along substantially the full length thereof, said helical water tube having water inlet means at one end thereof communicating directly with said outlet means of said coaxial water tube, said helical water tube also having water outlet means disposed at the opposite end thereof, each of said tubes being formed of a material of high thermal conductivity.

2. The structure of claim 1 in which said refrigerant-water thermal exchange assembly is disposed within a water container below the normal water level thereof.

3. The structure of claim 2 in which said outlet means of said helical water tube communicates directly with the interior of said container for the discharge of cool water into said container.

4. The structure of claim 3 in which means are provided for conducting chilled water from said container to industrial equipment requiring cooling.

5. The structure of claim 1 in which said helical water tube has its outer surface secured to the outer surface of said refrigerant tube.

6. A refrigeration system for chilling a circulating water supply for reuse in cooling industrial equipment, said system including a water container and at least two refrigerant-water thermal exchange assemblies disposed therein; each assembly comprising a coiled refrigerant tube having refrigerant inlet means at one end thereof for receiving refrigerant from a condenser and having refrigerant outlet means thereof for discharging the refrigerant to a compressor, a coaxial water tube disposed within said refrigerant tube, said coaxial water tube having an outside diameter substantially smaller than the inside diameter of said refrigerant tube and having water inlet means adjacent said refrigerant outlet means, said coaxial water tube also having water outlet means adjacent said refrigerant inlet means, and a helical water tube coiled about said refrigerant tube along substantially the full length thereof, said helical water tube having water inlet means at one end thereof communicating directly with said outlet means of said coaxial water tube, said helical water tube also having water outlet means disposed at the opposite end thereof, each of said tubes being formed of a material of high thermal conductivity; and water conduit means communicating with the water inlet means of the coaxial water tube of each of said refrigerant-water thermal exchange assemblies for conducting water thereto heated by industrial equipment.

7. The system of claim 6 in which each of said assemblies is disposed within said water container below the normal water level thereof, the water outlet means of said helical water tube of each said assembly communicating directly with the interior of said container.

8. The system of claim 6 in which said refrigerant inlet means of the refrigerant tube of each assembly is provided with a separate thermostatically-responsive expansion valve, each said thermostatically-responsive expansion valve having sensing means responsive to the temperature of refrigerant as it flows through the refrigerant outlet means of the refrigerant tube with which each said expansion valve is associated.

9. The system of claims 6, 7, or 8 in which said helical water tube of each assembly has its outer surface secured to the outer surface of said refrigerant tube of the same assembly.

10. The system of claim 6 in which the ratio of the inner diameter of each refrigerant tube to the outer diameter of the coaxial water tube disposed therein is on the order of 2:1.

11. The system of claim 10 in which said helical water tube of each assembly has cross sectional dimensions substantially the same as the coaxial water tube of that assembly.

12. The structure of claims 1 or 6 in which said helical water tube has its inlet means adjacent the outlet means of said refrigerant tube and has its outlet means adjacent the inlet means of said refrigerant tube.

* * * * *